US005334341A

United States Patent [19]

Streicher et al.

[11] Patent Number: 5,334,341

[45] Date of Patent: Aug. 2, 1994

[54] PROCESS FOR CONTROLLING CARBON CONTENT OF INJECTION MOLDING STEELS DURING DEBINDING

[75] Inventors: Eric Streicher, Viroflay, France; Randall M. German, State College, Pa.

[73] Assignee: L'Air Liquide, Societe Anonyme Pour L'Etude Et L'Exploitation Des Procedes Georges Claude, Paris, France

[21] Appl. No.: 888,600

[22] Filed: May 27, 1992

[51] Int. Cl.[5] ..... B22F 1/00

[52] U.S. Cl. ..... 419/53; 419/58

[58] Field of Search ..... 419/53, 58

[56] References Cited

U.S. PATENT DOCUMENTS

| | | | |
|---|---|---|---|
| 3,744,993 | 7/1973 | Matt et al. | 75/213 |
| 4,139,375 | 2/1979 | Soloman et al. | 75/224 |
| 4,225,344 | 9/1980 | Fujimori et al. | 75/203 |
| 4,836,980 | 6/1989 | Kashiwadani et al. | 419/53 X |
| 4,996,022 | 2/1991 | Shindo et al. | 419/53 X |
| 5,080,712 | 1/1992 | James et al. | 419/53 X |

*Primary Examiner*—Peter A. Nelson

*Attorney, Agent, or Firm*—Oblon, Spivak, McClelland, Maier & Neustadt

[57] ABSTRACT

A process for controlling the carbon content in a metallic piece molded by injection or other process comprising, a) heating the shaped piece under a 100% hydrogen atmosphere up to about 200° C., b) replacing the 100% $H_2$ atmosphere by a substantially 100% nitrogen atmosphere and heating the pieces from 200° C. to 450° C., c) maintaining the temperature in the enclosure at substantially 450° C. while subjecting the pieces to an atmosphere comprising from 15% to 100% vol. hydrogen, the complement being nitrogen, then d) replacing the atmosphere by a substantially 100% nitrogen and e) heating the pieces from 450° C. to substantially 700° C. in order to further eliminate the remaining binder.

10 Claims, 2 Drawing Sheets

PROCESS FOR CONTROLLING CARBON CONTENT OF INJECTION MOLDING STEELS DURING DEBINDING

BACKGROUND OF THE INVENTION

1. Background of the Invention

The present invention relates to a method of controlling the carbon content in a molded metallic piece and to a method of making sintered metallic pieces from a metallic carbon containing powder.

2. Description of the Background

Control of carbon content is one of the principal issues related to injection molding of metals. The difficulty arises mainly from the binder used for shaping, which decomposes during heat treatment and results in carburization. Residual carbon can be beneficial for materials, such as carbides, but there are instances where an excess of carbon is detrimental; for example, stainless steel, magnetic alloys and steels for which the carbon content must be carefully adjusted. The variation in carbon content may be due to a carburization arising from an incomplete binder degradation, but also from reaction in situ between carbon and the oxygen impurities of the powder or between carbon and the oxygen, or vapor water impurities of the furnace atmosphere. The effect of the atmosphere content on the powder during sintering is disclosed by D. R. Ryan and L. J. Cuddy in "Effect of Atmosphere Composition on the Sintering Behavior of Iron Powder Compacts", Pennsylvania State University.

The carbon content of the parts can be adjusted during a specific step after debinding, before sintering. The gas used for the treatment is usually a mixture of carbon monoxide and carbon dioxide. The carbon content of the compacts, c, is adjusted via the carbon potential of the atmosphere, ac, fixed by the $CO/CO_2$ ratio, according to the following relation:

$$c\ (\text{wt. }\%) = ac \text{ with } ac < 1$$

It is necessary that the treatment be done in a temperature range where the porosity of the sample is still high (about 20%) to allow rapid equilibrium between carbon content of the parts, throughout all the thickness, and carbon potential of the gas.

In practice, the control of carbon content via the mixtures $CO—CO_2$ is difficult to achieve because the $CO/CO_2$ ratio as well as the temperature of the treatment must be adjusted with precision. In an industrial furnace, temperature gradients and oxygen impurities in the flowing gas can shift the $CO/CO_2$ ratio and modify the carbon content of the parts. Moreover, this type of treatment is done in a batch furnace and is costly because it is difficult to automate and, is, moreover, time consuming.

Ideally, the carbon content of the compacts would be controlled throughout the debinding, wherein the binders are removed. Thus, the debinding should ideally and desirably afford a complete and clean decomposition of the binders and a reduction of the oxides of the powder. Preferably, the dew point and the oxygen impurities of the flowing gas during debinding and sintering could be lowered to a level where they would not influence the carbon content. In such a cased after sintering, the carbon content of the parts would be that of the starting powder.

However, at present, such a process does not exist, yet a need exists for a process for controlling the carbon content of injection molding steels during debinding.

SUMMARY OF THE INVENTION

Accordingly, it is an object of the present invention, to provide a process for controlling the carbon content in a metallic piece molded by injection or another process.

It is, further, an effect of the present invention to provide a process for producing sintered metallic pieces from a metallic carbon-containing powder.

The above aspects and others are provided by a process for controlling carbon content in a metallic piece molded by injection or another process, which entails a) heating the shaped piece under a substantially pure hydrogen atmosphere up to a first intermediate temperature, b) replacing the substantially pure hydrogen atmosphere by a substantially pure nitrogen atmosphere and heating the piece to a temperature range which is above said first intermediate temperature, while subjecting the piece to an atmosphere containing from about 15% to 100% vol. hydrogen, the remainder being nitrogen, then replacing the atmosphere with substantially pure nitrogen, and heating the piece to a temperature in excess of said temperature range in order to further eliminate the remaining binder.

DETAILED DESCRIPTION OF THE PREFERRED EMBODIMENTS

Figure 1A:
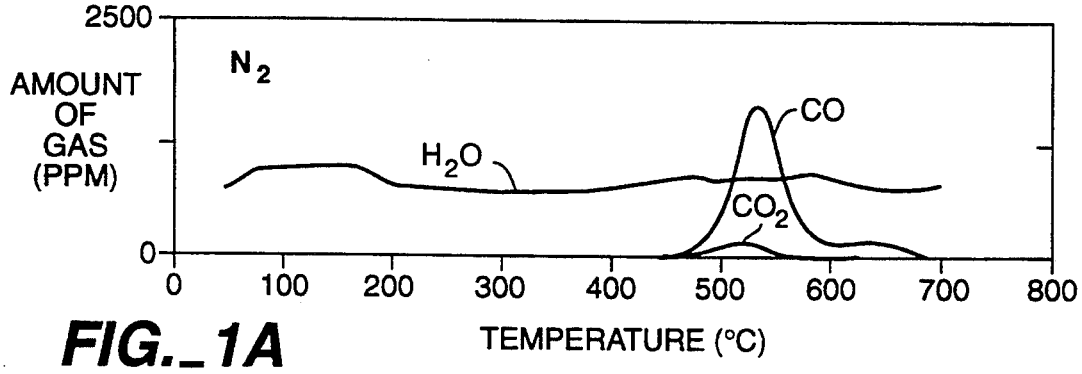
FIG. 1 is identification of the gas species formed during heat treatment of iron-2% nickel injection molded compacts under various gas compositions. The heating rate was 4° C. $min^{-1}$.
Figure 1B:
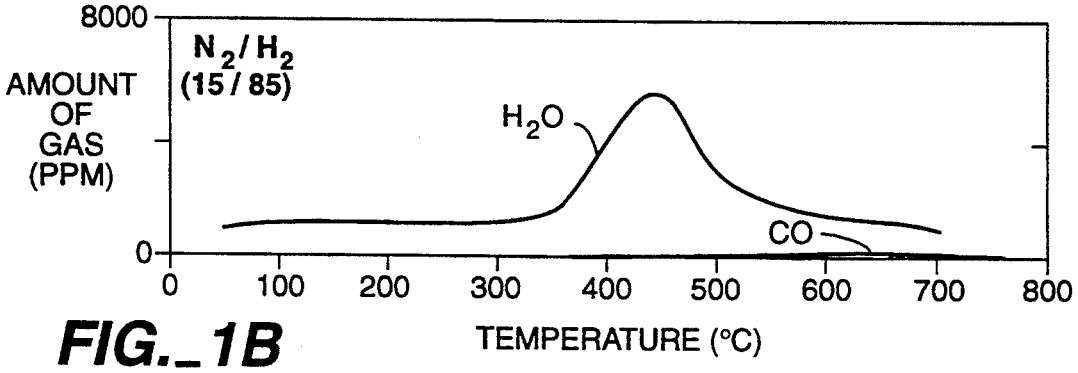
Figure 1C:
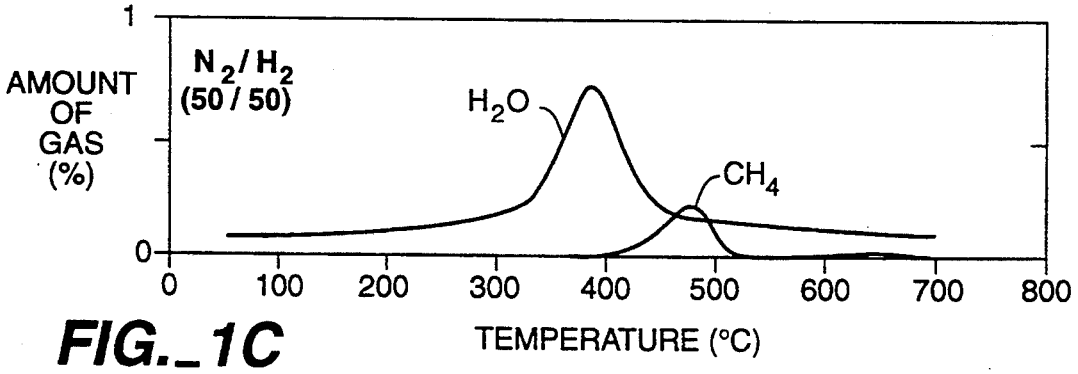
Figure 1D:
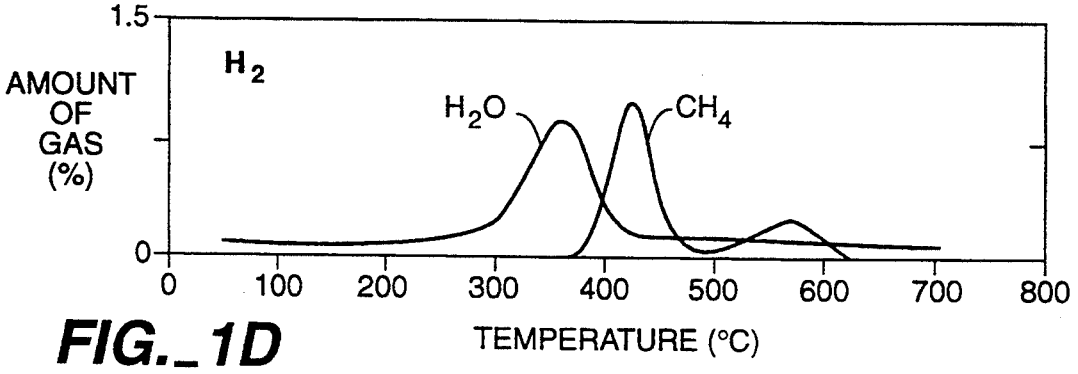

In accordance with the present invention, a process is provided for controlling carbon content in a metallic piece molded by injection or another process.

Generally, the present process entails heating a shaped piece in an enclosure up to a first intermediate temperature under a substantially pure hydrogen atmosphere, then replacing the substantially pure hydrogen atmosphere with substantially pure nitrogen and heating the piece within a temperature range which is above the first intermediate temperature, then subjecting the piece to an atmosphere containing from about 15 to 100 vol. % of hydrogen while d) maintaining the temperature in the enclosure at a temperature substantially the same as the temperature of the preceding step, and then subjecting the piece to substantially pure nitrogen, and e) heating the piece to a temperature which is higher than the temperature of the preceding step.

Further, in accordance with the present invention, the first temperature described above in step a) is an intermediate temperature of generally up to about 175° C. about 225° C. More preferably, the temperature is one of up to about 190° C. to about 210° C., and more preferably still up to about 200° C.

The temperature range for subsequent step b) is generally up to from about 425° C. to about 475° C., preferably up to about 450° C.

Thereafter, the temperature in step c) the enclosure is maintained at a temperature of about 425° C. to about 475° C., more preferably about 450° C. Then, in step d) the temperature is maintained substantially the same temperature from the preceding step.

Finally, in step e), the temperature is increased from about from the range of from 425° C. to 475° C. to about 650° C. to 750° C., more preferably about 675° C. to 725° C., and more preferably still about 700° C.

The present invention will now be further described by reference to certain Examples which are provided solely for purposes of illustration and which are not intended to be limitative.

Starting Materials

The powder was a mixture of iron and 2 wt. % nickel and the binder was a thermoplastic one based on paraffin wax, carnauba wax, polypropylene and stearic acid. The injection molding feedstock was prepared using a powder loading of 62.4 wt. %, then fed into a close loop reciprocating screw molding machine for shaping. Tensile specimens of 60 mm long, 15 mm wide and 3 mm thick were produced to study debinding. The starting powder had a carbon content of 0.86 wt. % and oxygen and nitrogen impurities of 0.315 wt. and 0.70 wt. %, respectively.

Debindinq Route

The binders were removed thermally by increasing the temperature. In order to limit distortion due to viscous flow, debinding occurred in two stages. A first stage at low temperature, between 150° and 200° C., to remove the lowest molecular weight species, i.e. the waxes. As the polymers burn off, the solid loading increases. If the solid loading increases up to a level where the particles are in contact, deformation due to viscous flow is impeded by the interparticles friction coefficient. The remaining fraction of the polymers can then be removed, with minimum risk of distortion, by increasing the temperature: it is the second stage of the debinding.

In this study, the first stage of the debinding consisted of a heating rate of 2° C. $min^{-1}$ up to 180° C. and hold for 10 hours at that temperature. The gas composition was pure hydrogen. Pure hydrogen was chosen as the debinding gas during the first step because it catalyzes binder decomposition (see F. L. Ebenhoech, *Carbonyl Iron Powder Production, Properties and Application, Progress of Powder Metallurgy,* vol. 42, Princeton Ed., 1986. Above 180° C., the heat treatment consisted of a heating rate of 4° C. min− up to 700° C., then cool down. Various combinations of nitrogen and hydrogen were tested during the second stage of debinding: pure nitrogen or hydrogen and nitrogen-hydrogen mixtures (15% and 50% of hydrogen in vol. %).

The reactions involved during the second stage of the debinding, above 180° C, were identified. Carbon monoxide and dioxide, methane and water vapor concentrations were determined as a function of the temperature and the nature of the debinding gas. The reactions observed during debinding of injected compacts are presented in FIG. 1. Two types of reaction were observed, i.e., (i) reduction of the oxides and (ii) decarburization. To evaluate the extent of the decarburization-reduction reactions, carbon and oxygen contents after treatment at temperatures between 550° C. and 700° C. were determined. The results are shown in Table 1.

Debinding in Pure Nitrogen

Under pure nitrogen, the reduction of the oxides took place by reaction between carbon and oxygen:

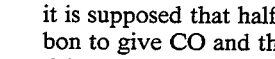

$$C+2FeO \rightarrow 2Fe+CO_2$$

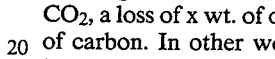

$$C+FeO \rightarrow Fe+CO$$

Carbon monoxide and dioxide were released in the temperature range from 500° to 700° C. These reactions led also to a decarburization. At 700° C., the carbon and oxygen contents of the debound compacts were 0.56 and 0.105 wt. %, respectively. By analysis, it appears that the reduction-decarburization occurs by reaction between carbon and oxygen to produce CO and $CO_2$. If it is supposed that half of the oxygen reacted with carbon to give CO and the other half with carbon to give $CO_2$, a loss of x wt. of oxygen would burn 0.563.x wt. % of carbon. In other words, debinding in pure nitrogen has the disadvantage to lead to a decarburization up to an extent dependent on the amount of oxygen impurities of the compacts. As the mixing and injection steps might lead to difficult to control oxidation, the carbon content of the debound and sintered parts might be itself difficult to control.

Debinding in Pure Hydrogen

Under pure hydrogen, the peak of water vapor between 300° and 400° C. was due to an oxide reduction:

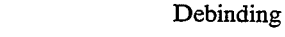

$$FeO+H_2 \rightarrow Fe+H_2O$$

A decarburization took place, mainly between 400° and 500° C., by reaction between carbon and hydrogen to give methane:

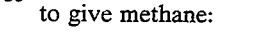

$$C+2H_2 \rightarrow CH_4$$

At 700° C., only a fraction of the oxides was reduced, but most of the carbon was burnt out: 850 ppm of oxygen and 100 ppm of carbon were left behind after debinding. The reduction of the remaining fraction of oxides is only possible under pure hydrogen at temperatures above 1100° C.(1). Because most of the carbon was burnt out by hydrogen reaction below 500° C., a further reduction of the oxides by carbon, as observed in the case of pure nitrogen, was not possible.

Debinding in nitrogen-hydrogen mixtures

The reactions observed during debinding under mixtures of nitrogen and hydrogen were the same as the ones under pure hydrogen, but carbon content analysis suggest that up to a specific concentration in the gas mixture, hydrogen is detrimental to binder removal. After debinding in the nitrogen and hydrogen mixtures tested (85/15 and 50/50 in vol. % a strong carburization of the parts was observed (see Table 1). The binders were not completely removed. Stangle et al. in "The Relative Importance of Thermal Cracking and Reforming during Binder Removal from Ceramic/Polymer Composites", ANTEC 1989, pp 1066-69, May 1-4, 1989, reported the same conclusions when comparing debinding in pure nitrogen and air for injection molded alumina-paraffin wax compacts. Even though oxygen should have favored binder decomposition (oxidative degradation), the degradation was complete at 300° C. in pure nitrogen and 500° C. in air. In air, oxidative degradation generated more diverse and higher molecular weight species than did thermal degradation in pure nitrogen. Data indicated that those products recombined to form large and stable compounds. Such compounds required high temperature or a high amount of oxygen to complete removal. In our case, as hydrogen catalyzes binder degradation (hydrogenation process), a wide range of molecular species might be expected. A recombination process of those species into stable compounds, difficult to remove, might explain the detrimental effect of hydrogen for binder degradation.

In conclusion, debinding in pure nitrogen allowed clean binder removal (no carburization), but had the drawback of a decarburization due to the combustion of carbon by oxygen impurities. Debinding in pure hydrogen led to complete decarburization. The mixtures of nitrogen and hydrogen led to an incomplete binder degradation resulting in a strong carburization.

Thus, the problem was to define the best debinding conditions of injection molding steels, i.e. ones that would allow binder removal without carburization or decarburization and also oxides reduction. The results suggest that a solution to this problem would be to use pure nitrogen during the second stage of the debinding, above 180° C. and up to 450° C. At that temperature, the oxides could be reduced using the 85% nitrogen and 15% hydrogen mixture. As soon as most of the oxides are reduced, the gas should be changed back to pure nitrogen until the end of debinding.

Having generally described the present invention, reference will now be made to certain examples which are provided solely for purposes of illustration and which are not intended to be limitative.

EXAMPLES

Figure 2:
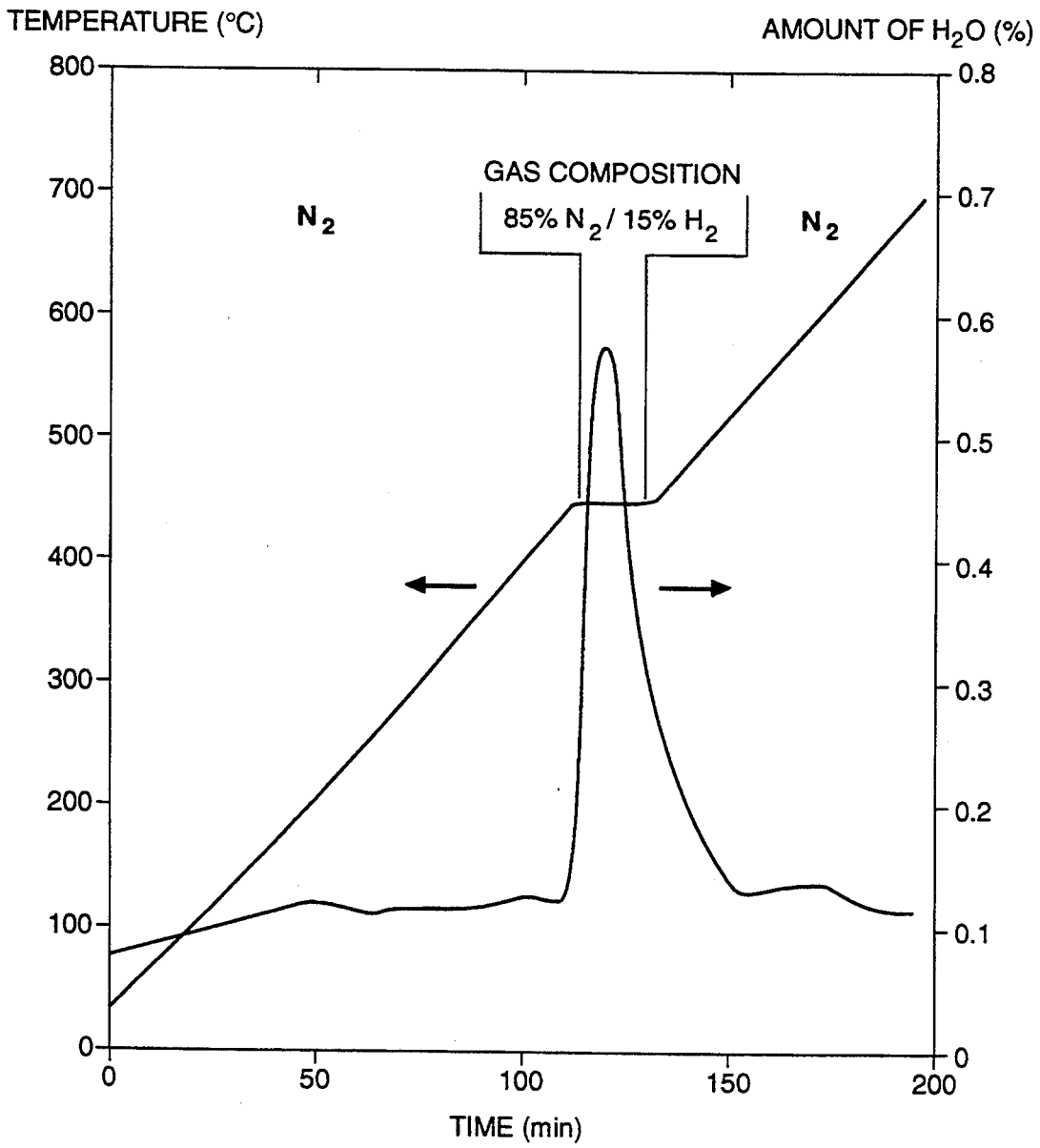
FIG. 2 is identification of the gas species formed during heat treatment of an iron-2% nickel injection molded compact under pure nitrogen up to 450° C., a mixture of 85% nitrogen and 15% hydrogen during the hold at 450° C. and eventually pure nitrogen again above 450° C. The heating rate was 4° C. $min^{-1}$.

The iron-2% nickel tensile specimens used above were treated in a batch furnace using a heating schedule consisting of a heating rate of 2° C. $min^{-1}$ up to 180° C., hold for 10 hours, then heat up again at 4° C. $min^{-1}$ up to 450° C. with a hold of 20 minutes at that temperature, then heat up again at 4° C. $min^{-1}$ up to 700° C. The gas was pure hydrogen up to 180° C., pure nitrogen between 180° and 450° C., a mixture of 85% nitrogen and 15% hydrogen during the hold at 450° C. and eventually pure nitrogen again above 450° C. The volume of the furnace was 5 liters, one specimen of 10 g. was treated using a flow rate of 1 liter $min^{-1}$. The reactions during debinding were determined, the results are shown in FIG. 2. The only reaction detected was the oxides reduction associated with the peak of water vapor at 450° C. The carbon and oxygen contents after debinding were 0.855 wt. % and 0.10 wt. %, respectively. Almost no decarburization and complete reduction of the oxides were achieved (the initial carbon concentration and oxygen concentration in the iron were respectively 0.86% wt. of carbon and 0.315% wt. of oxygen).

TABLE 1

Carbon and oxygen contents of iron- 2% nickel injection molded compacts, after heat treatment in various gas composition.

| Nature Gas | Temperature °C. | Carbon wt. % | Oxygen wt. % |
|---|---|---|---|
| $N_2$ | 550 | 0.67 | 0.161 |
| $N_2$ | 600 | 0.73 | 0.155 |
| $N_2$ | 700 | 0.56 | 0.105 |

TABLE 1-continued

Carbon and oxygen contents of iron- 2% nickel injection molded compacts, after heat treatment in various gas composition.

| Nature Gas | Temperature °C. | Carbon wt. % | Oxygen wt. % |
|---|---|---|---|
| $H_2$ | 550 | 0.07 | 0.129 |
| $H_2$ | 600 | 0.015 | 0.129 |
| $H_2$ | 700 | 0.01 | 0.085 |
| 85% $N_2$/15% $H_2$ | 600 | 1.04 | 0.123 |
| 50% $N_2$/50% $H_2$ | 600 | 1.47 | 0.126 |

The debinding conditions described in the present invention were defined for steel materials, but could be used to treat other materials such as alloys and ceramic, including stainless steels, superalloys, tool steels, and various carbides, nitrides or oxides. Moreover, the debinding process could be applied to all powder processing using organic phases to improve shaping: injection molding of course, but also conventional die pressing where lubricants such as wax or stearic acid are added to the powder to ease its flow in the die cavity, or slip casting, tape casting or other powder-binder mixtures.

Having described the present invention, it will be apparent to one of ordinary skill in the art that many changes and modifications can be made thereto without departing from the spirit or scope of the invention as set forth herein.

What is claimed as new and desired to be secured by Letters Patent of the United States is:

1. A process for controlling the carbon content in a metallic piece molded by injection or other process comprising, a) heating said shaped piece under a substantially pure hydrogen atmosphere only up to a temperature sufficient to remove low molecular weight constituents, b) replacing said substantially pure $H_2$ atmosphere with a substantially pure nitrogen atmosphere and heating the pieces to a temperature higher than that in step a), sufficient to remove binder without effecting carburization or decarburization, c) maintaining the temperature in the enclosure at substantially the same temperature in step b) while subjecting the pieces to an atmosphere comprising from 15% to 100% vol. hydrogen, the complement being nitrogen, then d) replacing said atmosphere by substantially pure nitrogen, and e) heating the pieces to a temperature sufficient to further eliminate the remaining binder.

2. The process according to claim 1, wherein in step a), a temperature of about 175° C. to about 225° C. is used.

3. The process according to claim 2, wherein a temperature of about 200° C. is used.

4. The process according to claim 1, wherein in step b), a temperature about 425° C. to 475° C. is used.

5. The process according to claim 4, wherein a temperature of about 450° C. is used.

6. The process according to claim 1, wherein in step e), a temperature of about 650° C. to about 750° C. is used.

7. The process according to claim 6, wherein a temperature of about 700° C. is used.

8. The process according to claim 1 wherein the first heating step to about 200° C. is substantially linear.

9. The process according to claim 1, wherein the first heating step to about 200° C. is done step by step.

10. The process according to claim 1, wherein the binder comprises wax, polymer or oil or a combination thereof wherein the heating temperature is maintained at about 200° C. during at least one minute.

* * * * *